US011369971B2

(12) United States Patent
Park et al.

(10) Patent No.: US 11,369,971 B2
(45) Date of Patent: Jun. 28, 2022

(54) CORN STALK PRETREATMENT APPARATUS AND METHOD FOR MANUFACTURING PULP FROM CORN STALKS

(71) Applicant: NEWTREE PNP CO., LTD., Seoul (KR)

(72) Inventors: Hyun Soo Park, Chungcheongnam-do (KR); Jong Myoung Won, Gangwon-do (KR)

(73) Assignee: NEWTREE PNP CO., LTD., Seoul (KR)

( * ) Notice: Subject to any disclaimer, the term of this patent is extended or adjusted under 35 U.S.C. 154(b) by 32 days.

(21) Appl. No.: 16/889,855

(22) Filed: Jun. 2, 2020

(65) Prior Publication Data

US 2020/0290055 A1 Sep. 17, 2020

Related U.S. Application Data

(62) Division of application No. 15/768,457, filed as application No. PCT/KR2016/010245 on Sep. 12, 2016, now Pat. No. 10,857,541.

(30) Foreign Application Priority Data

Oct. 14, 2015 (KR) ..... 10-2015-0143702

(51) Int. Cl.

| | |
|---|---|
| ***D21B 1/02*** | (2006.01) |
| ***D21H 11/12*** | (2006.01) |
| ***B02C 23/14*** | (2006.01) |
| ***B02C 13/286*** | (2006.01) |
| ***D21H 17/02*** | (2006.01) |
| ***B04B 1/00*** | (2006.01) |
| ***B02C 13/18*** | (2006.01) |
| ***B02C 21/00*** | (2006.01) |

(52) U.S. Cl.

CPC ..... *B02C 13/286* (2013.01); *B02C 13/18* (2013.01); *B02C 21/00* (2013.01); *B02C 23/14* (2013.01); *B04B 1/00* (2013.01); *D21B 1/025* (2013.01); *D21H 11/12* (2013.01); *D21H 17/02* (2013.01)

(58) Field of Classification Search

CPC ..... D21H 11/12; D21H 17/02; D21B 1/02; D21B 1/025; D21B 1/026; D21B 1/028; D21B 1/04; D21B 1/06; D21C 1/02; D21C 1/04; D21C 1/06; D21C 3/02; D21C 1/00; B02C 23/14

USPC ..... 162/91, 97, 99

See application file for complete search history.

(56) References Cited

FOREIGN PATENT DOCUMENTS

KR 10-1299665 * 9/2013 ..... D21H 17/02

OTHER PUBLICATIONS

KR 10-1299665, English language machine translation [https://patents.google.com/patent/KR101299665B1/en?oq=101299665] (Year: 2013).*

* cited by examiner

*Primary Examiner* — Eric Hug

(74) *Attorney, Agent, or Firm* — Osha Bergman Watanabe & Burton LLP

(57) ABSTRACT

A method of manufacturing pulp using corn stalks may include cutting the corn stalks into pieces having a length of 10 to 60 mm, separating and discharging the cut corn stalks into rind and pith using a separation unit while crushing the cut corn stalks, pretreating the corn stalks by filtering the rind and pith of the corn stalks and flakes of the rind, removing a portion of hemicellulose of the rind, and cooking the rind from which the portion of hemicellulose has been removed, using caustic soda and sodium carbonate.

8 Claims, 6 Drawing Sheets

CORN STALK PRETREATMENT APPARATUS AND METHOD FOR MANUFACTURING PULP FROM CORN STALKS

TECHNICAL FIELD

The present invention relates to a corn stalk pretreatment apparatus, and more particularly, to an apparatus and a technique for rind, pith, and scrap separation, which has been the greatest impediment to the mass production of high-quality paper-making pulp, thereby enabling the production of high-quality pulp using not only produced unbleached pulp having excellent strength as a material for manufacturing industrial packaging paper but also using bleached pulp as a material for specially made paper such as tissue paper and glassine paper and as a material for use in high grade printing and writing paper.

BACKGROUND ART

Generally, it has been known that paper is manufactured using wood pulp as a main material. Although pulp have been manufactured using herbaceous plants such as straw, bagasse, reed, and the like for a long time in countries that have a relative lack of wood resources due to small scale cottage industries, the pulp quality is very poor and it is difficult to dewater the pulp, which present difficulties in a paper manufacturing process. This reality caused a preference toward manufacturing high grade paper naturally using wood pulp. However, as civilization has rapidly developed and urbanized, environmental disruption has been worsened, such that recently, consequences such as ozone depletion, climate warming, and the like are causing severe problems which threaten the survival of the human race, such as ecosystem changes, sudden climatic changes, and the like.

Such environmental changes have forced major industrialized nations with a large amount of carbon emission to join the Climatic Change Convention, and even a market for certificated emissions reduction (CER) has been formed such that industries using energy have made much effort to obtain CER and bio-energy.

Meanwhile, logging has been restricted as part of environmental protection policy in Indonesia, which is known as a major wood producer, and logging has been suppressed in Brazil, which has been called the Earth's lung. These changes cause not only a rise in the price of wood pulp but also a war for securing pulp for manufacturing paper. This global trend has created an interest for obtaining fiber sources having a relatively short growth cycle.

As a representative example, attempts have been made for pulp resource recovery through the cultivation of kenaf, which has a relatively short growth cycle, and afforestation attempts have been made with tropical broadleaf trees which quickly grow, so as to use them as a pulp manufacturing material. However, despite these efforts, a fundamental solution has not been found yet. Accordingly, herbaceous plants which reproduce annually and pulp resource recovery of agricultural waste are drawing attention.

Particularly, herbaceous plants have properties morphologically and chemically different from those of wood. Although bast fiber and some herbaceous plant fibers have lengths longer than those of wood pulp fiber, most herbaceous plants include a larger amount of relatively fine or short parenchyma cells than that of wood pulp. Accordingly, when used as a paper manufacturing material, due to poor dewatering and low strength properties thereof, herbaceous plants are difficult to utilize and have merely been used in low grade paper manufacturing material in less-developed countries or countries which lack of wood resources. Herbaceous plants have chemical properties similar to those of broadleaf trees but generally have a low lignin content and a high hemicellulose content.

Meanwhile, after rice straws, corn stalks generate the most agricultural. Except for being partially used as feed, they have no particular use and are thrown out. Accordingly, an attempt of utilizing corn stalks as a source of pulp may be helpful not only for environmental protection but also in increasing rural household incomes through the utilization of waste for a source fiber.

Particularly, since corn stalks have a fiber length slightly longer and finer than that of broadleaf trees, difficulty in securing bulk is expected. However, problems with bulk may be partially improved through pre-extraction of hemicellulose. When corn stalks replace 10 to 40% of wood pulp, there is no negative influence on paper quality. When used for a particular purpose such as glassine paper and the like, corn stalks are more advantageous than wood pulp. Also, in comparison to wood, due to a much lower lignin content and a higher hemicellulose content, corn stalks have chemical properties adequate for manufacturing paper.

Since the pith of a corn stalk includes very fine parenchyma cells and a large amount of silica, the pith may cause many problems when used as paper manufacturing pulp unless separated from the rind. Since a technology of separating pith as described has not been developed, corn stalks are not generally used as a paper manufacturing material. Particularly, since dewatering is not performed well when parenchyma cells having a very small fiber size are present, production speed cannot be high in manufacturing paper and a large number of web breaks occur. Due to these reasons, even in China, in which a large amount of corn stalks are produced, corn stalks are limited to partial use in the production of low grade packaging paper.

A corn stalk treatment apparatus has been disclosed in Korean Patent Registration No. 10-1156148 (titled: Apparatus for Removing Corn Husk, registered on Jun. 7, 2012).

The above technical configuration is a related art for understanding the present invention and does not mean a conventional technology well known in the technical field to which the present invention belongs.

DISCLOSURE OF INVENTION

Technical Problem

Since existing equipment, which removes pith from a corn stalk, performs very complicated operations of splitting a corn stalk lengthwise and arranging the split corn stalk in a certain direction and then compressing the corn stalks so as to be wide and flat and raking out pith therefrom, the equipment has productivity and processing capacity insufficient for use in a pulp mill in which it is necessary to supply corn stalk chips of a minimum of several tens of thousands of tons to a maximum of several hundreds of thousand of tons per day. Accordingly, it is necessary to remedy this problem.

Therefore, the present invention provides a corn stalk pretreatment apparatus and a method of manufacturing pulp using corn stalks to remedy the above-described problems. The most significant technology in mass-producing high quality corn-stalk pulp is an operation of separating a pith part which deteriorates the yield and quality of pulp, increases chemical consumption, and includes a large amount of silica such that a difficulty in absorbing liquid chemicals occurs. The present invention provides an apparatus and a method for separating corn stalk pith, which essential for mass-producing pulp using corn stalks, to economically produce high quality pulp.

Also, the present invention also provides a corn stalk pretreatment apparatus and a method of manufacturing corn-stalk pulp to provide a method of manufacturing paper having a variety of properties such as industrial packaging, toilet paper, tissue paper, printing paper, and the like by maximizing advantages of corn stalks pulp and remedying issues of bulk.

Technical Solution

According to one aspect of the present invention, a corn stalk pretreatment apparatus includes a raw material fragmenting unit which receives, cuts, and fragments corn stalks, a foreign substance removal unit which receives the fragmented corn stalks and filters out foreign substances, a first separation unit which receives the corn stalks from which foreign substances have been removed and separates the corn stalks into rind and pith, a second separation unit which, after the corn stalks have been separated, separates the corn stalks into the rind and pith once more and crushes and finely fragments the rind and the pith into a chip form, a cyclone which receives the pith in the chip form and separates the contained rind, a final sorting unit which receives rind chips separated by the second separation unit together with rind chips separated by the cyclone and finally separates and discharges rind chips and pith chips, and a dust collection unit which collects, purifies, and discharges dust generated in the foreign substance removal unit and the final sorting unit.

The first separation unit may include a housing which receives the cut corn stalks and guides a discharge thereof, a drum which separates and discharges the corn stalks which flow into the housing into the rind and pith using a centrifugal force, a first transfer conveyer which transfers and supplies the rind to the second separation unit, and a first discharge conveyer which guides a discharge of the pith. The second separation unit may include a casing which guides the rind separated by the first separation unit and inserted into a top thereof using a freefalling method to be discharged through a bottom thereof and a rotor which is axially inserted into the casing and crushes the rind which flows thereinto into a chip form while separating the rind and pith.

The rotor may include a shaft axially inserted in the casing and rotated by an external force, a cover member into which the shaft is rotatably inserted and fixed and which is connected to the entire or a part of an open top of the casing, and a crushing portion which is formed on a circumferential surface of the shaft and crushes the rind and pith introduced into the casing.

The second separation unit may include an air blower which blows outside air into the casing to increase a period of time in which the rind and the pith come into contact with the crushing portion.

The crushing portion may include a plurality of plates formed along an axial direction of the shaft and a plurality of bars formed along an edge of each of the plates.

The crushing portion may include crushing ribs separably formed at the bars to crush the falling rind.

The dust collection unit may include a dust collection duct which is connected to the foreign substance removal unit and the final sorting unit and transfers and guides generated dust and a dust collector which purifies and discharges the dust transferred through the dust collection duct.

According to another aspect of the present invention, a method of manufacturing pulp using corn stalks includes cutting the corn stalks into pieces having a length of 10 to 60 mm, separating and discharging the cut corn stalks into rind and pith using a separation unit while crushing the cut corn stalk, pretreating the corn stalks by filtering the rind and pith of the corn stalks and flakes of the rind, removing a portion of hemicellulose of the rind, and cooking the rind from which the portion of hemicellulose has been removed, using caustic soda and sodium carbonate.

30 to 80 wt % of initial hemicellulose content of the rind may be removed.

A weight ratio of a cellulose content to hemicellulose in the rind, from which hemicellulose has been removed, may be between 2.2 and 7.69.

A hemicellulose content in the rind, from which hemicellulose has been removed, may be 11.5 to 31.3 wt %.

The removing of the portion of hemicellulose may be performed by pretreating the rind using water with a liquor ratio (a weight ratio of water:corn rind) of 5:1 to 10:1 at a temperature of 130 to 210 degrees for 30 to 200 minutes.

The removing of the portion of hemicellulose may be performed by pretreating the rind using water with a liquor ratio (a weight ratio of water:corn rind) of 5:1 to 10:1 at a temperature of 130 to 190 degrees and with an acid of 0.1 to 1.5% as a catalyst for 30 to 180 minutes.

The removing of the portion of hemicellulose may be performed by pretreating the rind using active alkali ($Na_2O$) of 5 to 21% with a liquor ratio (a weight ratio of alkaline solution:corn rind) of 5:1 to 10:1 at a temperature of 120 to 180 degrees for 30 to 150 minutes.

The rind may be manufactured by operations of cutting the corn stalks, compressing the cut corn stalks, crushing and fragmenting the compressed corn stalks, and separating the fragmented corn stalks into rind, pith, and leaves.

Advantageous Effects

As described above, a corn stalk pretreatment apparatus and a method of manufacturing corn-stalk pulp according to one embodiment of the present invention, unlike conventional technology, may manufacture high quality pulp under much milder conditions than those of existing technology by providing a pretreatment and chip manufacturing technology capable of manufacturing high quality pulp using corn stalks, which are agricultural waste.

The present invention may greatly contribute to an increase in rural household incomes and to environmental protection by providing a technology for producing high grade paper in which unbleached pulp is used as a raw material for producing industrial paper or which may be used for the production of not only tissue paper but also of printing paper through adequately proportionally mixing bleached softwood chemical pulp, bleached hardwood chemical pulp, bleached chemi-thermomechanical pulp, and the like with bleached corn-stalk pulp.

MODE FOR INVENTION

Figure 1:
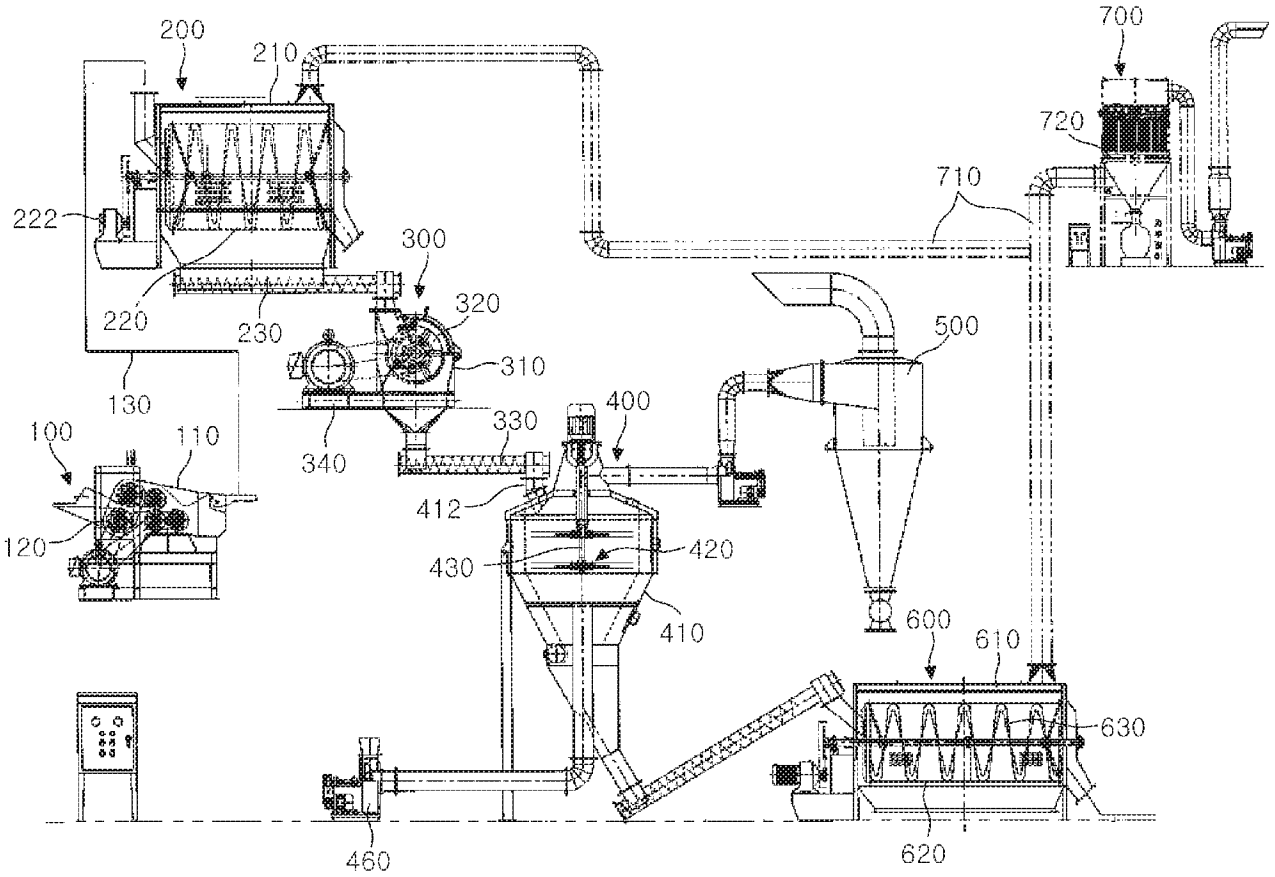
FIG. 1 is a configuration diagram of a corn stalk pretreatment apparatus according to one embodiment of the present invention.

Hereinafter, embodiments of a corn stalk pretreatment apparatus and a method of manufacturing pulp using corn stalks according to the present invention will be described with reference to the attached drawings. Here, thicknesses of lines, sizes of components, or the like shown in the drawings may be exaggerated for clarity and convenience of description. Also, the terms described below are defined considering functions thereof in the present invention, which may vary with intentions of a user and an operator or practice. Accordingly, the definitions of such terms should be given based on the content throughout the specification.

FIG. 1 is a configuration diagram of a corn stalk pretreatment apparatus according to one embodiment of the present invention.

Figure 2:
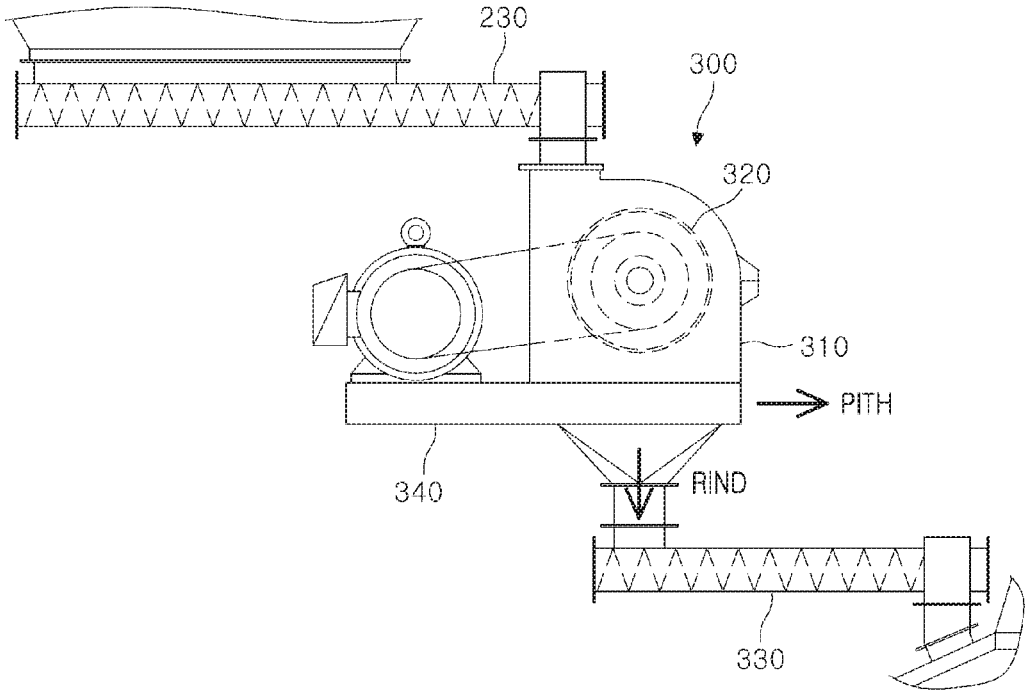
FIG. 2 is an enlarged view illustrating a first separation unit of the corn stalk pretreatment apparatus according to one embodiment of the present invention.
Figure 3:
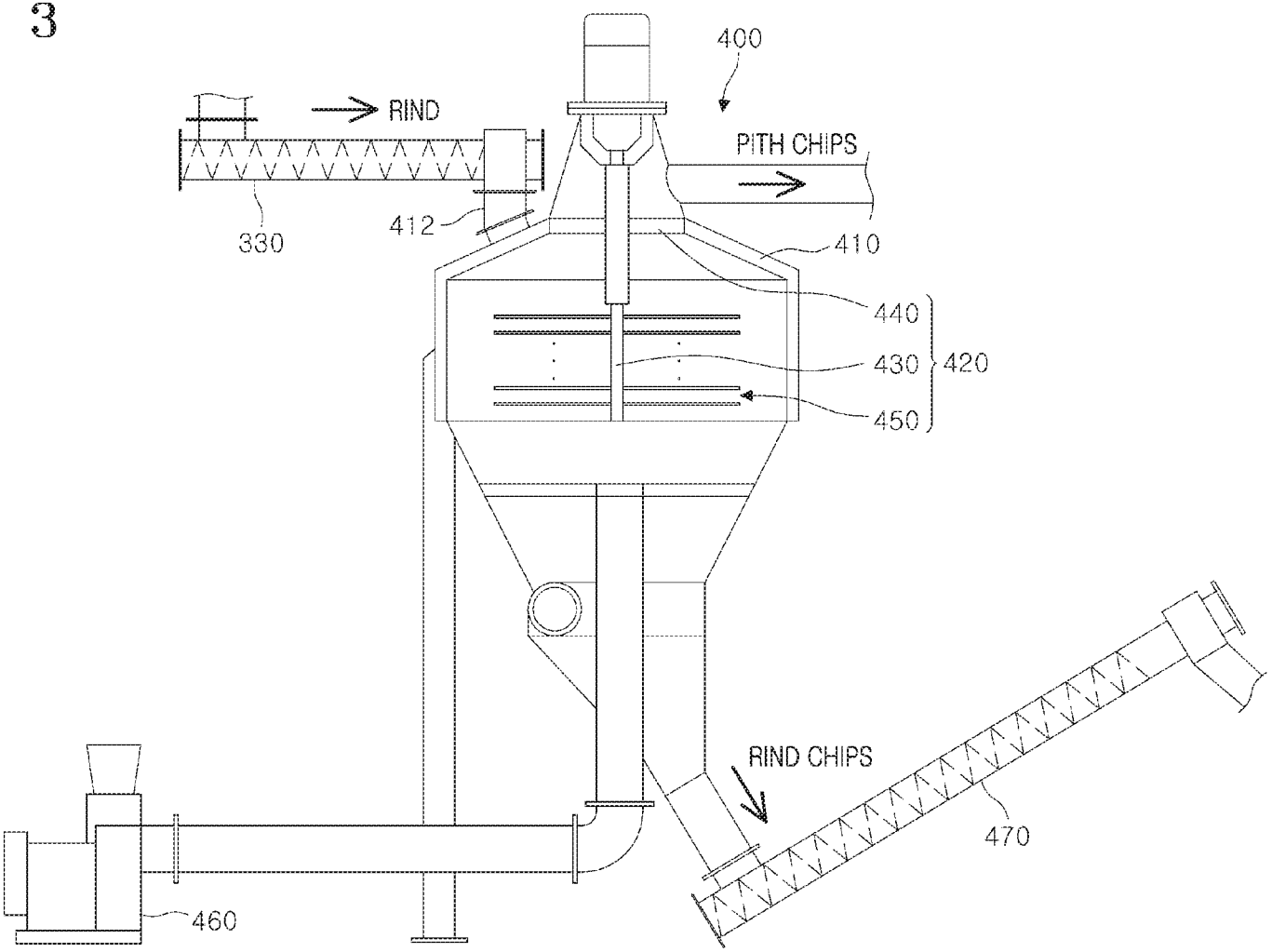
FIG. 3 is an enlarged view illustrating a second separation unit of the corn stalk pretreatment apparatus according to one embodiment of the present invention.

FIG. 2 is an enlarged view illustrating a first separation unit of the corn stalk pretreatment apparatus according to one embodiment of the present invention, and FIG. 3 is an enlarged view illustrating a second separation unit of the corn stalk pretreatment apparatus according to one embodiment of the present invention.

Figure 4:
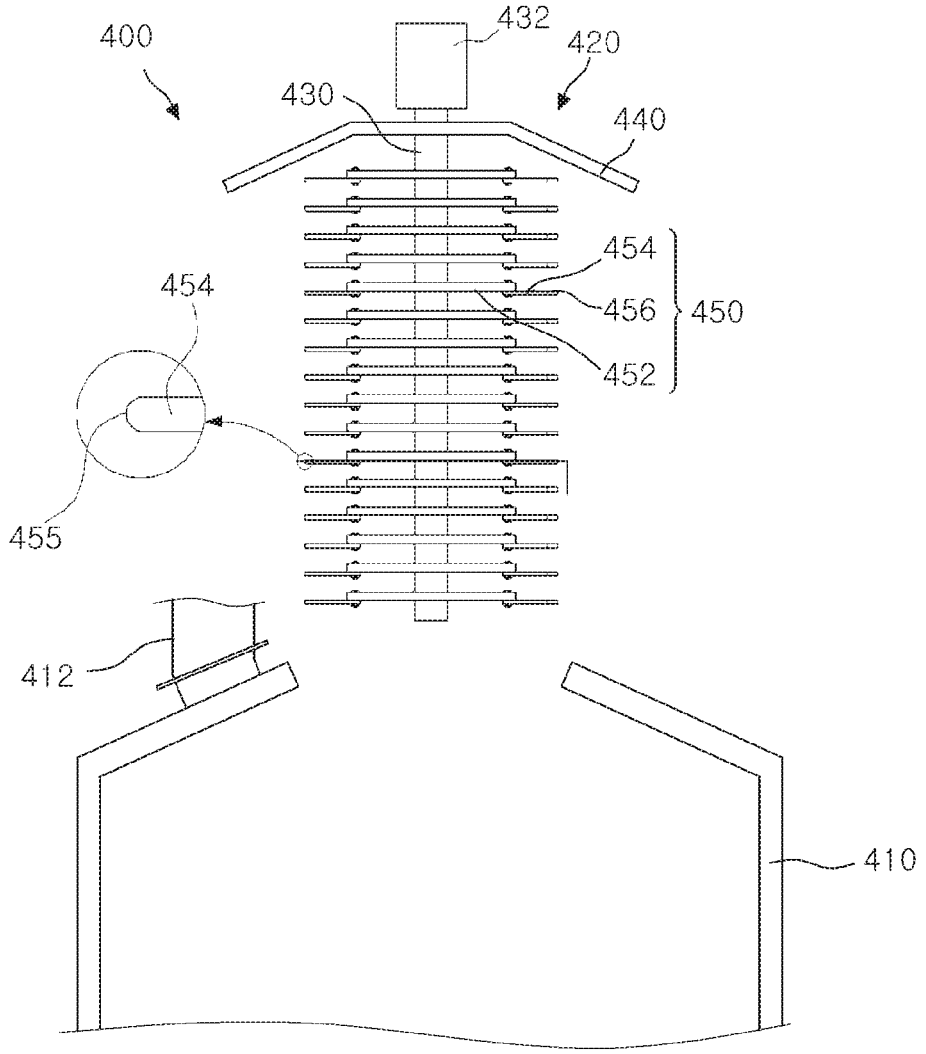
FIG. 4 is an exploded view illustrating a main part of the second separation unit of the corn stalk pretreatment apparatus according to one embodiment of the present invention.
Figure 5:
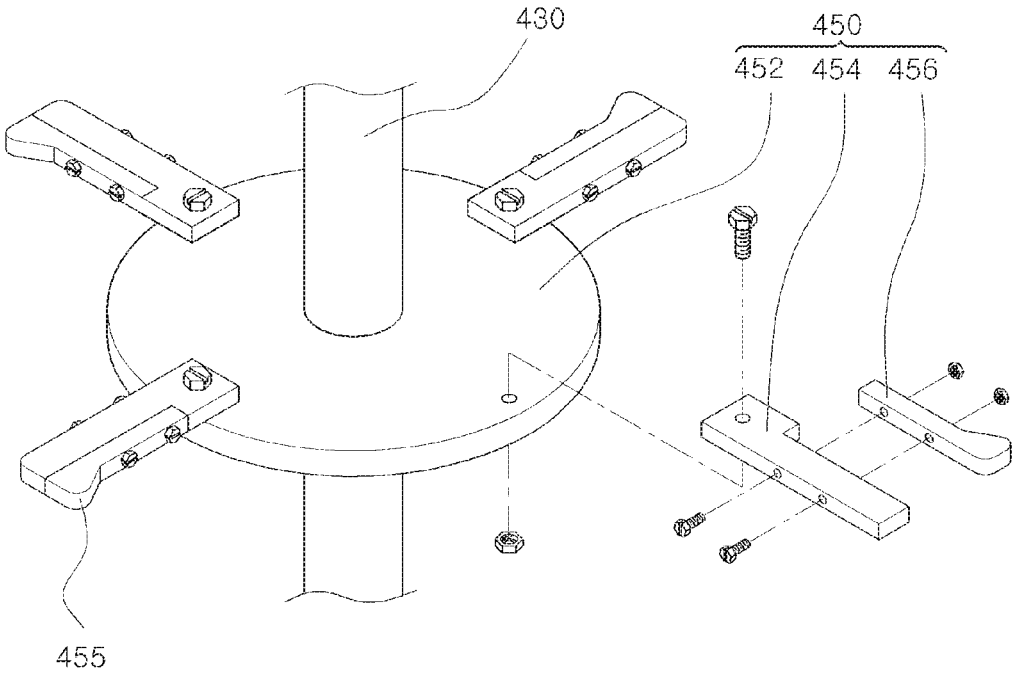
FIG. 5 is an exploded view illustrating a crushing portion of the second separation unit of the corn stalk pretreatment apparatus according to one embodiment of the present invention.

FIG. 4 is an exploded view illustrating a main part of the second separation unit of the corn stalk pretreatment apparatus according to one embodiment of the present invention, and FIG. 5 is an exploded view illustrating a crushing portion of the second separation unit of the corn stalk pretreatment apparatus according to one embodiment of the present invention.

Referring to FIGS. 1 to 5, the corn stalk pretreatment apparatus according to one embodiment includes a raw material fragmenting unit 100, a foreign substance removal unit 200, a first separation unit 300, a second separation unit 400, a cyclone 500, a final sorting unit 600, and a dust collection unit 700.

The raw material fragmenting unit 100 is equipment which receives, cuts and fragments corn stalks into pieces having a certain size or less.

Particularly, the external shape of the raw material fragmenting unit 100 is formed by a body 110 such that corn stalks may be supplied, cut, fragmented, and discharged, and the body 110 includes a fragmenting cutter 120 therein. The fragmenting cutter 120 may be provided to be divided into areas for cutting corn stalks supplied into the body 110 and areas for fragmenting the corn stalks. The fragmenting cutter 120 may be modified into a variety of shapes, and a variety of numbers of such fragmenting cutters 120 may be provided.

Also, the foreign substance removal unit 200 receives corn stalks fragmented by the fragmenting cutter 120 of the raw material fragmenting unit 100 and discharged from the body 110 and filters out foreign substances such as dust, corn leaves, and the like.

Here, corn stalks discharged from the body 110 are moved to the foreign substance removal unit 200 by an outside air pipe 130. Here, the outside air pipe 130 forcibly transfers outside air from the raw material fragmenting unit 100 to the foreign substance removal unit 200 using an outside air pump (not shown).

Particularly, the foreign substance removal unit 200 includes a frame 210 which receives corn stalks fragmented by the fragmenting cutter 120 and discharges the corn stalks from which foreign substances have been removed and includes a screener 220 provided inside the frame 210 to screen out foreign substances from corn stalks.

The frame 210 may be modified into a variety of shapes.

The screener 220, while allowing fragmented corn stalks to pass through therein, separates and discharges foreign substances such as dust, corn leaves, and the like mixed with the fragmented corn stalks through holes at a circumferential surface thereof.

Here, the screener 220 is rotated by a driving source 222 and is modifiable into a variety of shapes.

Also, the corn stalks discharged by the frame 210 are supplied along a fixed quantity transfer conveyer 230 to the first separation unit 300.

The fixed quantity transfer conveyer 230 may quantitatively transfer dropped corn stalks at a constant speed to quantitatively supply corn stalks to the first separation unit 300. Also, the fixed quantity transfer conveyer 230, when a dropped quantity not of the fixed quantity is sensed, may transfer corn stalks at a constant speed to quantitatively supply the corn stalks to the first separation unit 300 only after sensing a dropped quantity of the fixed quantity.

Meanwhile, the first separation unit 300 receives corn stalks from which foreign substances have been removed and separates the corn stalks into rind and pith. Here, the rind refer to an outer cover of the corn stalks and pith refers to an inside part.

Particularly, the first separation unit 300 includes a housing 310, a drum 320, a first transfer conveyer 330, and a first discharge conveyer 340.

The housing 310 is formed to receive cut corn stalks and guide the discharge of the cut corn stalks. A variety of shapes and a variety of materials may be applied to the housing 310.

The drum 320 has a cylindrical shape rotatably provided in the housing 310 and is installed to tilt gradually upward along an axial direction.

Then, corn stalks supplied to the drum 320 are subjected to a centrifugal force and are separated into rind and pith. Here, corn stalks are separated into rind having a relatively large volume or heavy specific gravity and pith having a relatively small volume or light specific gravity. Particularly, rind is tilted, moved to one side of the drum 320 at a low position, discharged therefrom, and transferred to the second separation unit 400. Additionally, pith may be titled and moved to the other side of the drum 320 at a high position and then discharged outward.

The first transfer conveyer 330 transfers and supplies rind separated and discharged by the housing 310 to the second separation unit 400, and the first discharge conveyer 340 guides a discharge of pith separated and discharged by the housing 310.

Here, the first transfer conveyer 330 and the first discharge conveyer 340 are modifiable into a variety of shapes, and sides which discharge rind and pith are at different locations in the housing 310.

Also, the second separation unit 400 separates again, into rind and pith, corn stalks which have already been separated once into rind and pith, and fragments the separated rind and pith into chips by crushing the separated rind and pith.

Here, the second separation unit 400 includes a casing 410 and a rotor 420.

The casing 410 causes the rind and pith of the corn stalks to be inserted above and discharged below using a freefalling method. The casing 410 is modifiable into a variety of shapes and is shown in a cylindrical shape for convenience. In addition, a variety of materials may be applied to the casing 410.

Particularly, the casing 410 is formed to freely drop the rind and pith. This is so that the rind and pith in the casing 410 do not stack, such that the rind and pith may be continuously supplied and the chips formed by crushing the rind and pith may be immediately discharged.

Also, the rotor 420 is axially inserted into the casing 410. Also, the rotor 420 is rotatably mounted in the casing 410. Also, the rind and pith are supplied to a top of the casing 410 and are then crushed in the casing 410 and discharged downward in a chip form.

Particularly, the rotor 420 includes a shaft 430, a cover member 440, and a crushing portion 450.

Also, the shaft 430 is axially inserted into the casing 410. That is, the shaft 430 is mounted to perpendicularly stand in the casing 410. Also, the shaft 430 is rotated in one direction by a driving motor 432. A variety of methods of transferring a driving force of the driving motor 432 to the shaft 430 may be applied.

In addition, the cover member 440 fixes a position of the shaft 430 and prevents rind and pith from being scattered toward a top of the casing 410 while colliding with the rotor 420.

That is, the cover member 440 is separably formed at the top of the casing 410 and the shaft 430 is rotatably mounted on a center. Although not shown in the drawings, the shaft 430 may include a ball bearing and may be assembled so as not to collide with the cover member 440 while rotating.

Particularly, the cover member 440 is formed to cover the entirety or a part of the open top of the casing 410.

Here, when the cover member 440 covers the entire open top of the casing 410, the casing 410 includes an inlet 412 separately formed at an upper circumferential surface to receive rind and pith. Here, the inlet 412 is formed at the upper circumferential surface of the casing 410 in order to increase a period of time in which rind and pith supplied into the casing 410 are crushed in the casing 410 for maximum crushing of the rind and pith.

Also, when the cover member 440 closes a part of the open top of the casing 410, the open part of the top of the casing 410 performs a function of the inlet 412. The cover member 440 is modifiable into a variety of shapes and is separably coupled with the top of the casing through a variety of methods such as bolting and the like. In addition, the cover member 440 may be separably formed at a bottom of the casing 410 but may be applied to the top of the casing 410 to smoothly discharge rind and pith in the chip form.

Also, the crushing portion 450 is formed on a circumferential surface of the shaft 430 and directly crushes rind and pith inserted through the inlet 412 of the casing 410. The crushing portion 450 is fixedly formed at the shaft 430 in order to maximize a crushing force applied to the rind and pith due to rotation of the shaft 430.

Particularly, the crushing portion 450 includes a plate 452, bar 454, and a crushing rib 456.

A plurality of such plates 452 are formed on the circumferential surface of the shaft 430. Here, the plurality of plates 452 are formed along an axial direction of the shaft 430, and a shape and materials of the plates 452 may be variously modified.

Also, the plates 452 are coupled and fixed to the shaft 430 using a variety of methods such as clamping and the like. The plates 452 may be formed to be integrated with the shaft 430. The number of the plates 452 is not limited.

Also, a plurality of such bars 454 are formed along an edge of each of the plates 452. A pair of bars 454 are provided to crush the rind and pith. Particularly, a pair of bars 454 having different lengths may be provided as alternately arranged bars having different lengths. This is to increase a crushing force to the rind and pith.

Also, the bar 454 may be separably formed at the plate 452.

Here, the bar 454 includes a curved portion 455. The curved portion 455 is curvedly formed on a circumferential surface of the bar 454, which comes in direct contact with the rind and pith and performs functions of crushing the rind and pith and preventing or minimizing damage during separation.

In addition, the shaft 430 is connected to a gearbox (not shown) and is adjustable in rotation speed. This is to adjust the rotation speed of the shaft 430 to prevent pulverization caused by excessively crushing the rind and pith. The gearbox connects the driving motor 432 to the shaft 430.

Also, the crushing rib 456 is separably formed at the bar 454 and crushes falling rind and pith. That is, the rind and pith are directly crushed by the crushing rib 456 so as to reach a chip form. The crushing rib 456 is separably formed at the bar 454 to be maintainable and repairable.

Particularly, the crushing rib 456 is formed at a side of the bar 454, which faces a rotational direction, to maximally crush the rind and pith. The crushing rib 456 is modifiable into a variety of shapes.

Meanwhile, the second separation unit 400 may further include an air blower 460.

The air blower 460 blows outside air into the casing 410 to allow the rind and pith to float in the casing 410 in order to increase a period of time during which the rind and the pith come into contact with the bars 454 and the crushing ribs 456 of the crushing portion 450.

Also, the cyclone 500 receives pith in a chip form and separates rind attached to the corresponding pith once more.

Here, the cyclone 500 causes the inflow of pith to rotate. As the pith is rotated in the cyclone 500, the pith and rinds are separated from each other such that the rind having a heavy specific gravity is discharged below and the pith having a light specific gravity is discharged above.

Here, the cyclone 500 is modifiable in a variety of shapes.

Also, the final sorting unit 600 receives rind chips separated by the second separation unit 400 and rind chips separated by the cyclone 500 and finally separates and discharges the rind and pith.

Here, the rind chips separated by the second separation unit 400 are quantitatively transferred and supplied along the second transfer conveyer 470. The second transfer conveyer 470 may quantitatively transfer rind chips separated by the second separation unit 400 and rind chips separated by the cyclone 500 together.

Particularly, an external shape of the final sorting unit 600 is formed of a body 610 into which different rind chips separated by the second separation unit 400 and the cyclone 500 flow and from which finally separated rind chips and pith chips are discharged.

The external shape includes a circular cylinder 620 formed therein, and the circular cylinder 620 includes holes formed at a circumferential surface thereof to pass the separated rind chips. In addition, the circular cylinder includes a rotatable screw 630. The screw 630 transfers pith after rind chips are separately discharged from the circular cylinder 620.

Accordingly, the final sorting unit 600 finally separates only rind such that high-quality pulp and the like may be produced utilizing the finally separated rind.

Meanwhile, the dust collection unit 700 collects dust generated inside the frame 210 of the foreign substance removal unit 200 and the body 610 of the final sorting unit 600 for purification and discharges the collected dust.

The dust collection unit 700 includes a dust collection duct 710 and a dust collector 720.

The dust collection duct 710 is connected to the frame 210 of the foreign substance removal unit 200 and to the body 610 of the final sorting unit 600 and forcibly or naturally transfers and guides dust generated therein.

The dust collector 720 passes dust transferred through the dust collection duct 710 and purifies and then discharges the dust.

Particularly, when the dust collection duct 710 of the dust collection unit 700 suctions dust inside the frame 210 and the body 610 or dust flows therein, it is necessary to adjust a suction force so as not to allow rind in the frame 210 and rind in the body 610 to flow into the dust collection unit 700.

In addition, since the dust collection unit 700 suctions the dust in the frame 210 and the body 610, finally discharged rind does not have dust attached thereto or attached dust is reduced enough such that clean rind may be collected and accordingly quality and productivity of the pulp being produced may be increased.

The dust collection duct 710 may be connected to the body 110, the housing 310, and the casing 410 and may transfer and guide dust to the dust collector 720.

Figure 6:
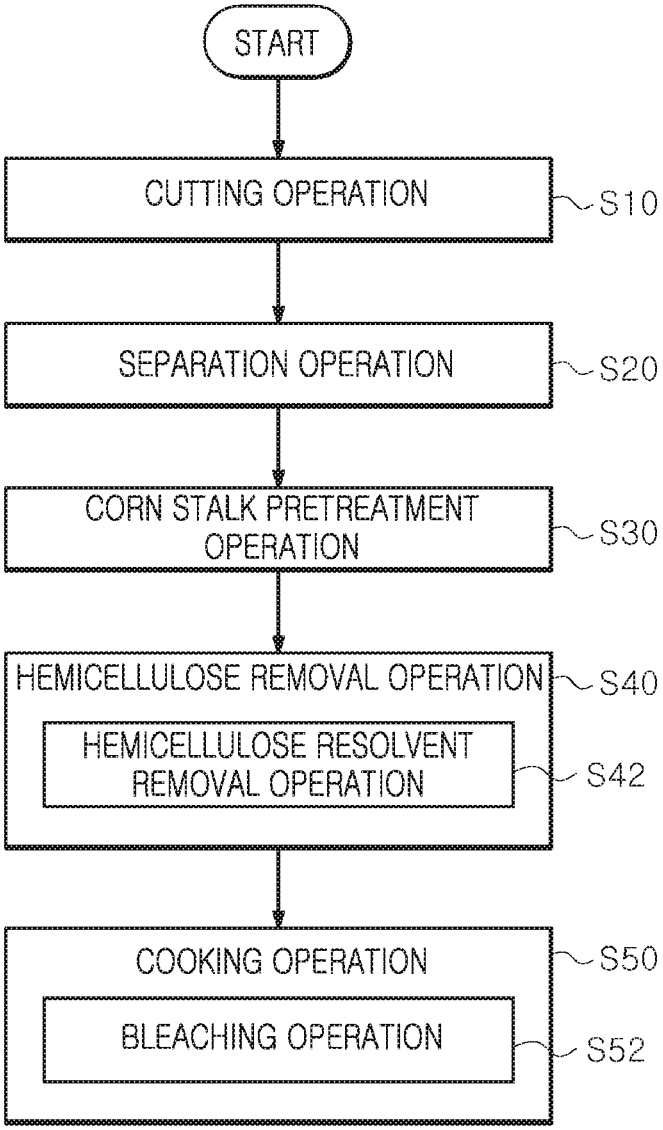
FIG. 6 is a flowchart illustrating a method of manufacturing pulp using corn stalks according to one embodiment of the present invention.

FIG. 6 is a flowchart illustrating a method of manufacturing pulp using corn stalks according to one embodiment of the present invention.

Referring to FIGS. 1 and 6, the method of manufacturing pulp using corn stalks according to one embodiment of the present invention includes a cutting operation S10, a separation operation S20, a corn stalk pretreatment operation S30, a hemicellulose removal operation S40, and a cooking operation S50.

The cutting operation S10 is a process of supplying corn stalks to the raw material fragmenting unit 100 and cutting the corn stalks into pieces having a length of 10 to 60 mm.

When corn stalks are cut into pieces less than 10 mm, a fabric cutting phenomenon of the corn stalks may worsen. When corn stalks are cut into pieces more than 60 mm, a problem of the corn stalks not being well separated into rind and pith occurs.

Particularly, dust, corn leaves, or the like are removed from the cut corn stalks by the foreign substance removal unit 200.

Also, the separation operation S20 is a process in which the cut corn stalks are separated into rind and pith and crushed by the first separation unit 300 and the second separation unit 400 to be converted into a chip form. Here, the first separation unit 300 and the second separation unit 400 refer to the above-described devices.

In addition, the corn stalk pretreatment operation S30 is a process of filtering the rind and pith of the corn stalks and flakes of the rind. This process S30 is performed using the cyclone 500 and the final sorting unit 600.

Here, "rind of a corn stalk" means a part of a corn stalk which includes rind, pith or cob, and leaves, from which leaf and pith or cob parts are removed. Also, only the rind part of the corn stalks is used for manufacturing corn-stalk pulp. When pulp is manufactured using all of the rind, pith or cob, and leaves which form a corn stalk, pulp manufacturing efficiency is low in consideration of the large amount of chemicals consumed during cooking. Also, since a large amount of parenchyma cell fibers having a very short fabric length are contained, dewaterability may be poor and the strength of paper manufactured using corn-stalk pulp may be low.

Also, the separated pith or cob and leaves, in addition to the rind, may be used in a bio refinery process which includes manufacturing cellulose ethanol. Corn-stalk pulp may be embodied accordingly, and simultaneously, industrial applicability or reusability of by-products thereof may be increased.

In the method according to one embodiment of the present invention, the process S40 of removing a portion of hemicellulose through a pretreatment which includes eluting the portion of hemicellulose from the corn rind is performed.

The corn rind includes hemicellulose, cellulose, lignin, and the like. The lignin having a hydrophobic property is removed through a pulping process to manufacture pulp using corn stalks. Particularly, due to high flexibility caused by inherent properties of fiber, the pulp manufactured using corn stalks has a property of higher interfiber bonding than that of wood pulp. In addition, unlike wood, since a corn stalk includes a large amount of hemicellulose which plays a significant role in interfiber bonding, bulk and opacity are excessively decreased when manufacturing paper.

Accordingly, the process S40 of eluting and removing the portion of hemicellulose in fiber which forms the corn rind may be performed after the corn stalk pretreatment operation S30.

Due to this, interfiber bonding ability is adjusted to maintain strength as well as to improve bulk and opacity such that an effect of increasing the value of substituting wood pulp with corn stalk pulp may be embodied.

In the case of hemicellulose, 30 to 80 wt % of an initial hemicellulose content of the corn rind is eluted and removed. Within the above range, an effect of improving bulk and opacity of paper and strength of paper may be provided. Preferably, 40 to 65 wt % and more preferably 42 to 55 wt % is removed.

Hemicellulose, is not limited, and may be pentosan, hexosan, xylan, arabinoxylan, glucomannan, xyloglucan, or a mixture thereof.

Particularly, after the portion of hemicellulose has been removed, a weight ratio B/A of cellulose as B to hemicellulose as A in the corn rind may be between 2.2 and 7.69. Within the above range, an effect of improving bulk and opacity of paper and strength of paper may be provided. Preferably, the weight ratio may be 2.56 to 3.85.

In addition, after the portion of hemicellulose has been removed, the content of hemicellulose in the corn rind may be 11.5 to 31.3 wt %. Within the above range, an effect of improving bulk and opacity of paper and strength of paper may be provided. Preferably, the content ratio may be 20.3 to 28.1 wt %, and more preferably, 22.6 to 26.3 wt %.

Here, the content of hemicellulose in pulp fiber may be measured using a general method. For example, the content of hemicellulose in pulp fiber is measurable using a quantitative content of pentosan (TAPPI test method T223, PAPTAC test method G.12).

Also, after the portion of hemicellulose has been removed, the content of hemicellulose in the corn rind may be 68.7 to 88.5 wt %. Within the above range, an effect of improving bulk and opacity of paper and strength of paper may be provided. Preferably, the content ratio may be 71.94 to 81.47 wt %, and more preferably, 72.62 to 77.3 wt %.

Hemicellulose may be eluted and removed from corn rind as necessary by adjusting pretreatment conditions of corn stalks.

As one example of the pretreatment method, the operation S40 of removing hemicellulose may be performed by pretreating the corn rind with water at a liquor ratio (weight ratio of water:corn rind) of 5:1 to 10:1 at a temperature of 130 to 210 degrees for 30 to 200 minutes. In the above conditions, initial hemicellulose content of the corn rind is adjusted to be within a preferable range according to the present invention, such that corn stalk pulp which maintains a strength property and has improved bulk and opacity may be manufactured.

Preferably, the pretreatment may be performed using water having a liquor ratio of 6:1 to 8:1 and at a temperature of 140 to 180 degrees for 60 to 150 minutes.

As another embodiment of the pretreatment, operation S40 of removing the portion of hemicellulose may be performed through a pretreatment in water for 30 to 180 minutes with a liquor ratio (weight ratio of water:corn rind) of 5:1 to 10:1 and using water at a temperature of 130 to 190 degrees and with an acid of 0.1 to 1.5% (based on a weight with respect to corn rind) as a catalyst. In the above conditions, initial hemicellulose content of the corn rind is adjusted to be within a preferable range according to the present invention, such that corn stalk pulp which has improved bulk and opacity may be manufactured.

Here, the acid may be employed as, for example, sulfuric acid, formic acid, hydrochloric acid, and the like. However, when an excessive amount of acid larger than the above conditions is used, even cellulose which is a main element of corn-stalk pulp is decomposed in addition to hemicellulose, such that a low molecular weight phenomenon occurs and excessively decreases strength of the pulp.

An acid solution concentration may be 0.1 to 2.5% (weight reference with respect to water).

Preferably, the pretreatment may be performed using water having a liquor ratio of 6:1 to 8:1 and at a temperature of 140 to 180 degrees and with an acid of 0.5 to 1.5% as a catalyst for 60 to 150 minutes.

As another embodiment of the pretreatment method, the operation S40 of removing the portion of hemicellulose may be performed by pretreating 5 to 21% of active alkali (with respect to a weight of a corn rind) at a liquor ratio (a weight ratio of an alkaline solution:corn rind) of 5:1 to 10:1 at a temperature of 120 to 180 degrees for 30 to 150 minutes. In the above conditions, initial hemicellulose content of the corn rind is adjusted to be within a preferable range according to the present invention, such that corn stalk pulp which has improved bulk and opacity may be manufactured.

The active alkali may employ a mixture of NaOH, $Na_2CO_3$, NaOH/$Na_2S$, or KOH and the like but is not limited thereto.

Preferably, the pretreatment may be performed using 5 to 1.5% of active alkali (as $Na_2O$) having a liquor ratio of 6:1 to 8:1 and at a temperature of 140 to 170 degrees for 60 to 120 minutes.

The pretreatment may include simple treatment, heating, or the like but is not limited thereto.

A product obtained by pretreating corn rind as described may be used directly for manufacturing corn-stalk pulp through a cooking process. However, to further improve properties of corn-stalk pulp, the method may further include operation S42 of removing hemicellulose eluted from the above result or decomposed hemicellulose, not only so that eluted hemicellulose may be used to synthesize useful chemicals but also, for example, to prevent unnecessary consumption of cooking chemicals.

For example, hemicellulose or decomposed hemicellulose may be separated and refined using a method such as filtration, precipitation, phase separation, and the like.

The separated hemicellulose or decomposed hemicellulose may be used as a material for manufacturing useful chemical materials such as xylose, ethanol, and the like through an additional refinement or process.

Meanwhile, the cooking operation S50 is a process of cooking the corn rind obtained by the hemicellulose removal operation S40 or the decomposed hemicellulose removal operation S42 with caustic soda and sodium carbonate.

Conditions for cooking may differ according to a use of corn-stalk pulp. That is, when unbleached corn-stalk pulp is used for manufacturing industrial paper, milder conditions may be used. On the other hand, when bleached pulp is manufactured and used for printing and writing paper, more intense conditions may be used.

The cooking operation S50 may use, for example, a soda process, a kraft process, and the like but is not limited thereto.

When the soda process is applied, the soda process may be performed by heating 14 to 20% of active alkali ($Na_2O$) at a liquor ratio (a weight ratio of an alkaline solution:corn stalk chips) of 4:1 to 9:1 at a temperature of 130 to 190 for 90 to 180 minutes but is not limited thereto.

Alkali for the alkaline solution may be NaOH, $Na_2CO_3$, KOH, and the like and a solvent may be water, but are not limited thereto.

Also, anthraquinone may be used as an additive for increasing a yield and improving quality in the cooking process. A concentration may be 0.05 to 0.8%. When the kraft process is applied, the kraft process may be performed by heating 13 to 18% of active alkali ($Na_2O$) with a sulphidity of 20 to 30% at a liquor ratio (a weight ratio of a kraft solution:corn stalk chips) of 4:1 to 8:1 at a temperature of 130 to 180 for 70 to 150 minutes but is not limited thereto.

Kraft cooking chemicals for a kraft solution may be NaOH and $Na_2S$ and a solvent may be water, but are not limited thereto.

In detail, the cooking operation S50 may be performed by with 12 to 16% of active alkali concentration and a liquor ratio of 3:1 to 6:1 at a temperature of 120 to 150° C. for 60 to 150 minutes.

Also, in the cooking operation S50, 0.05 to 0.2% of anthraquinone may be added to minimize decomposition of hemicellulose and increase a pulp yield.

Also, after the cooking operation S50, a bleaching operation S52 of discharging a cooking liquor, processes of dust elimination, screening, enrichment, and the like, and bleaching may be further included. Bleaching may be performed by applying any bleaching method used for wood pulp or existing corn-stalk pulp. Bleaching may be included to produce tissue paper, printing or writing paper, toilet paper, and the like.

Corn-stalk pulp manufactured according to one embodiment of the present invention may be used for manufacturing fine paper, coating base paper, toilet paper, printing paper, and the like but is not limited thereto.

Particularly, the pretreatment method using corn stalks according to one embodiment of the present invention provides a technology for manufacturing high-quality paper pulp using corn stalks to use as a material for manufacturing industrial packaging or producing toilet paper and tissue paper after bleaching. Also, provided is a method of manufacturing high-quality printing paper by remedying a problem of the quality of printing paper of paper manufactured using corn-stalk pulp by proportionally mixing a variety of types of pulp such as softwood bleached chemical pulp, hardwood bleached chemical pulp, bleached chemi-thermo-mechanical pulp (BCTMP), and the like having a variety of properties.

The most economically significant factor in manufacturing high-quality pulp using corn stalks is separating and removing parenchyma cells having a relatively short fiber length and pith parts having a high silica content. When these parts are not sufficiently removed, not only does consumption of chemicals increase but also pulp yield decreases. Also, since a large amount of parenchyma cells corresponding to fines in manufactured pulp is included, dewatering is not well performed, such that it is impossible to increase a paper manufacturing speed and paper strength decreases. Also, a problem in which chemical additives added to paper to provide a variety of functions are selectively adsorbed by parenchyma cells occurs such that efficiency of the additives decreases.

A cut length is important in efficiently removing pith from rind. Since a rind part is not well separated when a length of a cut corn stalk is too long, it is difficult to separate and remove when an external force is applied. Through the present study, it can be seen that the rind and pith are easily separated when corn stalks are cut into pieces having a length of 15 mm to 60 mm.

Since a corn stalk, unlike wood, has a low lignin content and a high hemicellulose content as shown in Table 1, pulping thereof is easier. Although it is possible to apply a variety of pulping processes usable for manufacturing wood pulp, that is, a kraft process, a sulfite process, a soda-AQ process, and the like, delignification is completely performed using only a soda process. Accordingly, cooking chemicals may be NaOH and a mixture containing $Na_2CO_3$ as necessary. Chemicals introduced are converted into $Na_2O$, and 12 to 16% of active alkali is applied such that pulp having a better properties may be obtained when performing cooking in mild conditions. The above-described mild cooking conditions are applied such that it is possible to omit a pretreatment process using cellulose protection additives such as $MgCl_2$ or $MgCO_3$. Chemicals and energy costs may be reduced through omission of the process, and production time may be reduced. Also, 0.05 to 0.2% of anthraquinone may be added in order to minimize decomposition of hemicellulose and to increase a pulp yield. A liquor ratio may be adjusted to be within a range of 3:1 to 6:1 depending on a property of pulp to be obtained. When a liquor ratio increases, the concentration of a cooking liquid chemical decreases such that a problem in which a chemical reaction notably decreases may occur. A cooking temperature is adjusted to be within a range of 120 to 150° C., and a cooking time is adjusted to be within a range of 60 to 150 minutes according to the amount of applied chemicals introduced, a temperature, and a property of pulp to be manufactured.

TABLE 1

| Raw Material | Cellulose (%) | Pentosan (%) | Lignin (%) |
|---|---|---|---|
| Softwood | 40 to 50 | 10 to 14 | 24 to 30 |
| Hardwood | 40 to 50 | 16 to 24 | 18 to 28 |
| Cornstalk | 42 to 51 | 26 to 28 | 16 to 18 |

The liquid chemicals are removed from completely cooked pulp by washing, incompletely cooked corn-stalk chips or large contaminants are removed by screening like in manufacturing wood pulp, and contaminants having a high specific gravity are removed using a dust cleaner. Screened portions are screened once more using a vibrating screen such that incompletely cooked and dissociated fiber mass is sent back to a digester.

After washing and contaminant removal are completely finished, unbleached corn stalk pulp is separately used or mixed with unbleached softwood kraft pulp or unbleached hardwood kraft pulp to be used as a material for manufacturing industrial packaging or cardboard. Here, a refining process is performed to obtain adequate strength. Since corn-stalk pulp is much weaker than wood pulp, refining is performed at a low intensity of 0.2 to 1.0 Ws/m. By adjusting freeness of pulp to be a CSF freeness of 500 to 350 ml, industrial paper of a desired basis weight is manufactured.

It is necessary to perform bleaching processes on corn-stalk pulp to use the pulp as a raw material for manufacturing specially made paper such as facial tissues, glassine paper, and the like or fine paper. Since corn stalks have a low lignin content as shown in Table 1, delignification is very easy. Accordingly, unlike wood pulp, adequately high brightness may be obtained by limiting the number of bleaching sequences to 3. Also, recently, since dioxin may be generated when elemental chlorine is used as a bleaching agent, the bleaching sequences may employ an elemental chlorine free or totally chlorine free method. Although the bleaching methods are already being applied to the bleaching of wood pulp and 5 sequences of bleaching are generally performed, considering that bleaching of corn-stalk pulp is easy, 3 sequences of bleaching is applied when pulp having brightness of 80 to 90% is to be produced. However, when a particularly high brightness of 90% is necessary, 4 sequences of bleaching may be applied. As an ECF bleaching method, a variety of bleaching processes such as DED, DEP, DEO, DEZ, PED, PEP, DEDP, DEOZ, DEDZ, DEOP, DEPD, and the like may be applied. Here, D is an abbreviation of chlorine dioxide, E is an abbreviation of alkaline extraction, P is an abbreviation of peroxide, O is an abbreviation of oxygen, and Z is an abbreviation of ozone.

To provide necessary characteristics for each respective use, when fine paper or coating base paper is manufactured, a stock preparation process including refining, pulp blending, sizing, filter loading, and the like are necessary. The process is identically applied when not only wood pulp but also all usable types of pulp are used. However, for remedying shortcomings of corn-stalk pulp and satisfying properties of paper to be produced, it is a key to optimize the application of blending wood pulp, filler, sizing agents, retention aids, and the like. Accordingly, in the embodiments of the present invention, differences from a case in which existing wood pulp is used will mainly be described.

Corn-stalk pulp has a property in which fiber is much finer than wood pulp as shown in Table 2. Also, since hemicellulose content is high as shown in Table 1, when paper is manufactured using only bleached corn-stalk pulp, a disadvantage of excessively high density causing opacity to decreases occurs. In the case of fine paper, it may be easily recognized that bulk and opacity are very important and need to be compensated for. When paper is manufactured using existing wood pulp, to remedy shortcomings of each pulp, softwood pulp, hardwood pulp, and a small amount of mechanical pulp are mixed and used.

TABLE 2

| Raw Material | Average Fiber Length (mm) | Average Fiber Diameter (mm) |
|---|---|---|
| Softwood | 2.7 to 4.6 | 32 to 43 |
| Hardwood | 0.7 to 1.6 | 20 to 40 |
| Cornstalk | 1.0 to 1.5 | 18 to 22 |

Since corn-stalk pulp has fine fibers as described above, flexibility is excellent and hemicellulose content is high such that fiber bonding is better than in other pulp fibers. Accordingly, adequate strength may be easily obtained by merely operating a deflaker instead of refining. A large amount of energy is necessary in a refining process following a drying process in a paper manufacturing process. In the case of wood pulp, power consumed for decreasing freeness of 100 ml CSF through refining reaches about 71 kW/t (hardwood) to 84 kW/t (softwood) per ton of pulp. When it is assumed that 1,000 tons of pulp are refined per day and hardwood refining energy is applied and converted, 71,000 kW of electric energy may be saved, and 21,300,000 kW of electric energy may be saved over 300 days of operation per year. When corn-stalk pulp is used as a paper manufacturing material as described above, a large part of manufacturing costs may be reduced by omitting refining, which is hoped to be a suitable solution for the difficulty the paper industry faces in consideration of a situation in which there has been intensified pressure to reduce greenhouse gas emissions.

Since basis weight is low when tissue paper such as toilet paper is produced, in order to provide strength, filler is not used, and absorption, a water annealing property, and softness properties are very important, particularly when toilet paper is manufactured. Since it has a fiber length slightly longer and a diameter finer than those of hardwood and a high hemicellulose content, corn-stalk pulp has properties particularly suitable for manufacturing toilet paper, tissue paper, and glassine paper. Since corn-stalk pulp is very weak but has excellent bonding properties, it is adequate to only treat corn-stalk pulp 2 or 3 times using a deflaker. Here, the deflaker refers to equipment which applies only a light force to pulp fiber. Also, refining refers to an operation of fibrillation or cutting fiber by applying compression, tensile, and shearing forces.

As a result of manufacturing facial tissues using 100% corn-stalk pulp, excellent properties are obtained as shown in Table 3. When toilet paper with a slightly bulky structure and absorption are necessary, such as toilet paper for use with a bidet, toilet paper is manufactured by proportionally mixing 5 to 10% of bleached softwood kraft pulp, 20 to 40% of bleached hardwood kraft pulp, and 40 to 60% of corn-stalk pulp. Here, wood pulp is refined and adjusted freeness of 400 to 550 ml CSF in order to be mixed.

To manufacture printing paper, bulk, opacity, smoothness, and the like are considered as significant factors. To compensate for corn-stalk pulp's low bulk and low opacity caused by inherent properties thereof, bleached softwood chemical pulp, bleached hardwood chemical pulp, bleached chemi-thermomechanical pulp, and the like are mixed therewith to manufacture paper. A mixture ratio may be adjusted, depending on properties of paper to be manufactured, to be within a range of 1 to 5% of bleached softwood chemical pulp, 20 to 50% of bleached hardwood chemical pulp, 20 to 50% of corn-stalk pulp, and 5 to 10% of bleached chemi-thermomechanical pulp. Corn-stalk pulp is treated using only the deflaker, like in manufacturing toilet paper, and softwood and hardwood chemical pulp is refined to have freeness of 400 to 500 ml CSF.

As a filter, precipitated calcium carbonate (PCC), ground calcium carbonate (GCC), talc, and clay may be used, and an introduced amount thereof may be adjusted, according to a use of paper to be manufactured, to be within a range of 5 to 25%.

As a sizing agent, alkyl ketene dimer (AKD), alkenyl succinic anhydride (ASA), reinforcement rosin emulsion, and the like may be used, and an amount introduced thereof may be adjusted to be within a range of 0.05 to 6%. Since the filler and the sizing agent cannot attach to pulp fiber, it is necessary to use retention aids. As the retention aids, cationic starch, amphoteric starch, cationic and anionic polyacrylamide, polyethylene imine, colloidal silica, bentonite, organic microparticles, and the like may be used.

EMBODIMENT

The following embodiments are related to a method and quality of pulp production using corn stalks and paper manufacturing and show the excellence of the present invention. Accordingly, the scope of the present invention is not limited or defined by the embodiments.

Embodiment 1

Corn stalks were cut into lengths of 1.5 cm and crushed for 10 minutes using a high-speed rotary machine and separated into pith and rind by a screen. 400 g of the separated rind was taken and introduced into a laboratory digester (volume of 4 liters), and 13% of active alkali and sodium hydroxide made as an aqueous solution corresponding to 15% were introduced. A liquor ratio was 5:1, and corn-stalk chips were pressed using a metal weight thereon so as to be adequately submerged under a cooking liquor and cooked at a temperature of 150° C. for 70 minutes, 90 minutes, and 120 minutes. The completely cooked corn-stalk chips were washed, and rejects were removed using a vibrating screen. Completely screened pulp was measured for pulp yield, kappa number, and brightness, was light mechanical force was applied thereto for 10 minutes using a laboratory beater without a weight, and then handsheets having a basis weight of 60 g/m2 were manufactured using a laboratory handsheet machine. The manufactured handsheets were dried and wetted in a constant temperature and humidity chamber for one day and then measured for apparent density, tensile index, and burst index on the basis of TAPPI standards. Results of the experiment are summarized in Table 3, and it can be seen that unbleached corn-stalk pulp was adequately used as an industrial paper manufacturing material in consideration of the quality thereof.

TABLE 3

| Active Alkali (%) | Cooking Time (min.) | Careful Sorting Yield (%) | Kappa Value | Brightness (%) | Density (g/cm$^3$) | Tensile Index (Nm/g) | Rupture Index (kPam$^2$/g) |
|---|---|---|---|---|---|---|---|
| 13 | 70 | 42 | 14.6 | 31.4 | 0.49 | 85 | 5.87 |
| | 90 | 46.3 | 13.4 | 33.1 | 0.54 | 105 | 6.98 |
| | 120 | 47.1 | 11.5 | 35.8 | 0.58 | 114 | 7.67 |
| 15 | 70 | 44.5 | 12.2 | 35.4 | 0.53 | 96 | 6.54 |
| | 90 | 45.8 | 10.7 | 36.2 | 0.62 | 118 | 7.85 |
| | 120 | 43.2 | 9.6 | 37.1 | 0.56 | 108 | 7.23 |

Embodiment 2

100% bleached corn-stalk pulp and wood chemical pulp were initially mixed and compared with KS standards and trial manufactured goods in order to evaluate toilet paper properties of the bleached corn-stalk pulp. Breaking strength, tensile strength, and absorbency of toilet paper manufactured using corn-stalk pulp all satisfied KS standards, and the breaking strength in particular was better than that of commercial toilet paper.

TABLE 4

| | Corn | KS Standards | | Made Marketable | |
|---|---|---|---|---|---|
| | Stalk Pulp | Toilet Paper | Facial Tissues | Daehan Pulp (Facial Tissues) | Yuhan Kimberly, LTD (Facial Tissues) |
| Basis Weight (g/m$^2$) | 18 | 18 or more | 12.5 or more | 24 or more | 24 or more |
| Breaking Strength (kPa) | 136 | 78 or more | — | 50 or more | 50 or more |
| Tensile Strength (N/15 mm) | 1.2 | — | 0.78 or more | — | — |
| Absorbency (mm) | 48 | 20 or more | — | — | — |

Embodiment 3

A laboratory study was performed to provide manufacturing paper having excellent bulk and opacity by mixing bleached corn-stalk pulp with bleached softwood chemical pulp, bleached hardwood chemical pulp, bleached chemi-thermomechanical pulp, and the like. A microparticle system using ground calcium carbonate as a filler and bentonite and cationic polyacrylamide as retention aids was applied. According to experimental results, it can be seen that bulk and opacity, which were the largest disadvantages of corn-stalk pulp, were improved by mixing a variety of types of pulp.

TABLE 5

| Properties | Corn-Stalk Pulp (100%) | Corn-Stalk Pulp (50%) Softwood Pulp (5%) Hardwood Pulp (40%) BCTMP (5%) | Corn-Stalk Pulp (40%) Hardwood Pulp (55%) Rice Straws (5%) | Corn-Stalk Pulp (40%) Softwood Pulp (10%) Hardwood Pulp (50%) |
|---|---|---|---|---|
| Basis Weight (g/m$^2$) | 70.1 | 70 | 69.8 | 71.2 |
| Bulk (cm$^3$/g) | 1.05 | 1.32 | 1.28 | 1.16 |

TABLE 5-continued

| Properties | Corn-Stalk Pulp (100%) | Corn-Stalk Pulp (50%) Softwood Pulp (5%) Hardwood Pulp (40%) BCTMP (5%) | Corn-Stalk Pulp (40%) Hardwood Pulp (55%) Rice Straws (5%) | Corn-Stalk Pulp (40%) Softwood Pulp (10%) Hardwood Pulp (50%) |
|---|---|---|---|---|
| Tensile Index (Nm/g) | 49.5 | 52.1 | 50.4 | 51.7 |
| Rupture Index (kPam$^2$/g) | 1.92 | 1.89 | 1.86 | 1.78 |
| Opacity (%) | 81.6 | 92.8 | 89.6 | 91.5 |
| Ash (%) | 15 | 14.9 | 15.1 | 15 |

Although the embodiments of the present invention have been described with reference to the drawings, it should be understood that they are merely examples and various modifications and equivalents thereof may be made by one of ordinary skill in the art. Accordingly, the veritable technical scope of the present invention should be defined by the following claims.

The invention claimed is:

1. A method of manufacturing pulp using corn stalks comprising:

cutting the corn stalks into pieces having a length of 10 to 60 mm;

filtering out foreign substances from cut pieces of the corn stalks;

separating and discharging the cut corn stalks into rind and pith under a centrifugal force using a separation unit;

separating the corn stalks into rind and pith once more and crushing and finely fragmenting the rind and the pith into a chip form;

pretreating the corn stalks by filtering the rind and pith of the corn stalks and flakes of the rind;

removing a portion of hemicellulose of the rind; and cooking the rind from which the portion of hemicellulose has been removed, using caustic soda and sodium carbonate.

2. The method of claim 1, wherein 30 to 80 wt % of initial hemicellulose content of the rind is removed.

3. The method of claim 2, wherein a weight ratio of a cellulose content to hemicellulose in the rind, from which hemicellulose has been removed, is between 2.2 and 7.69.

4. The method of claim 1, wherein a hemicellulose content in the rind, from which hemicellulose has been removed, is 11.5 to 31.3 wt %.

5. The method of claim 1, wherein the removing of the portion of hemicellulose is performed by pretreating the rind using water with a liquor ratio (a weight ratio of water:corn rind) of 5:1 to 10:1 at a temperature of 130 to 210 degrees for 30 to 200 minutes.

6. The method of claim 1, wherein the removing of the portion of hemicellulose is performed by pretreating the rind using water with a liquor ratio (a weight ratio of water:corn rind) of 5:1 to 10:1 at a temperature of 130 to 190 degrees and with an acid of 0.1 to 1.5% as a catalyst for 30 to 180 minutes.

7. The method of claim 1, wherein the removing of the portion of hemicellulose is performed by pretreating the rind using active alkali ($Na_2O$) of 5 to 21% with a liquor ratio (a weight ratio of alkaline solution:corn rind) of 5:1 to 10:1 at a temperature of 120 to 180 degrees for 30 to 150 minutes.

8. The method of claim 1, wherein the rind is manufactured by operations of:

cutting the corn stalks;

compressing the cut corn stalks;

crushing and fragmenting the compressed corn stalks; and separating the fragmented corn stalks into rind, pith, and leaves.

* * * * *